US006272983B1

(12) United States Patent
Plant Chupurdy

(10) Patent No.: US 6,272,983 B1
(45) Date of Patent: Aug. 14, 2001

(54) STAMPING DEVICE FOR IRREGULAR SURFACES

(76) Inventor: Donna L. Plant Chupurdy, 26 Wexford Dr., Hilton Head Island, SC (US) 29928

( * ) Notice: Subject to any disclaimer, the term of this patent is extended or adjusted under 35 U.S.C. 154(b) by 0 days.

(21) Appl. No.: 09/477,356

(22) Filed: Jan. 4, 2000

(51) Int. Cl.[7] ..... B41F 17/20

(52) U.S. Cl. ..... 101/41; 101/35; 101/327; 101/492

(58) Field of Search ..... 101/35, 41, 327, 101/474, 407.1, 492

(56) References Cited

U.S. PATENT DOCUMENTS

| | | | | |
|---|---|---|---|---|
| 435,459 | | 9/1890 | Schulze-Berge | 101/39 |
| 1,326,843 | * | 12/1919 | Brewer | 101/41 |
| 1,701,348 | | 2/1929 | Wright | 101/41 |
| 2,027,637 | * | 1/1936 | Eaton | 101/297 |
| 2,077,790 | | 4/1937 | Hakogi | 101/35 |
| 2,739,532 | | 3/1956 | Fernandez | 101/126 |
| 2,745,339 | | 5/1956 | Fernandez | 101/41 |
| 2,748,696 | | 6/1956 | Murray | 101/41 |
| 2,842,046 | | 7/1958 | Murray | 101/41 |
| 3,718,085 | | 2/1973 | Perret | 101/40 |
| 3,745,970 | | 7/1973 | Scantlebury | 118/50 |
| 3,885,522 | | 5/1975 | MacDonald et al. | 101/163 |
| 4,098,184 | | 7/1978 | Okada et al. | 101/41 |
| 4,163,421 | | 8/1979 | Sihota | 101/41 |
| 4,508,031 | | 4/1985 | Rajnik | 101/41 |
| 5,542,768 | * | 8/1996 | Rother et al. | 400/120.16 |
| 5,669,303 | | 9/1997 | Maracas et al. | 101/327 |

FOREIGN PATENT DOCUMENTS

| | | | | |
|---|---|---|---|---|
| 424226 | * | 5/1911 | (FR) | 101/41 |
| 472796 | * | 1/1936 | (GB) | 101/41 |
| 92/20005 | * | 11/1992 | (WO) . | |

* cited by examiner

*Primary Examiner*—Daniel J. Colilla
(74) *Attorney, Agent, or Firm*—Finnegan Henderson Farabow Garrett & Dunner, LLP

(57) ABSTRACT

A stamping device, simple in application and construction, is disclosed for transferring an image to an irregularly surfaced object. The stamping device includes a frame having an upper region capable of receiving a surface of an object to be printed and a transfer medium mounted across the upper region of the frame for receiving an image from a stamp and transferring the image to the surface of the object. The design of the stamping device enables users to transfer an image from a stamp block to an irregularly surfaced object with increased precision and without complex procedures and machinery. Furthermore, the stamping device enjoys a simplistic and collapsible design, which promotes compact transport and storage of the device.

9 Claims, 8 Drawing Sheets

STAMPING DEVICE FOR IRREGULAR SURFACES

BACKGROUND OF THE INVENTION

1. Field of the Invention

The present invention concerns the design and operation of a stamping device for stamp hobbyists. More specifically, the present invention is directed toward a stamping device that transfers a stamped image to an irregularly surfaced object with increased ease and precision.

2. Description of the Prior Art

Since the advent of the printing block, the art of stamping has expanded to where its present use ranges from making simple design impressions to technical printing presses. Stamping or decorating surfaces has become widespread, from the reproduction of corporate insignias to mere decorative designs. Designers have developed different design variations to accommodate particular printing needs. However, there exists a need for a practical and relatively inexpensive device for transferring an image from a flat printing block to an irregularly surfaced object, as desired by a stamp hobbyist. Stamp hobbyists generally require a stamping device simple in application and construction, and capable of rapidly stamping numerous objects of varying dimensions and surface irregularities, including spherical, concave, and/or convex surfaces.

Presently existing devices for transferring images to irregular surfaces generally require procedures and configurations that are incompatible with the freehand transfers of an image by a stamp hobbyist. For example, conventional stamping devices frequently include rigid mechanical parts, which require that application of substantial forces as well as precise positioning between the image and the surface of the object to be printed. Such devices often further limit their application by requiring that the printed object be of a particular size and shape. In general, the techniques currently used for image transfer are cumbersome and complex to manipulate and impractical for transferring images to objects of differing dimensions. Further, many of the conventional stamping systems are simply too expensive for hobbyists to purchase. Because of these problems, many hobbyists have limited their practice to stamping only those objects having planar surfaces.

In view of the limitations and complexity of existing stamping devices and methods, a need has arisen, particularly among stamp hobbyists, for a device capable of transferring an image to an irregularly surfaced object, which is simple in application and construction.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the stamping device of the present invention comprises a frame having a first and a second side and an upper region located between the sides and capable of receiving a surface of an object to be printed with an image and a transfer medium mounted across the upper region of the frame for receiving the image from a stamp and transferring the image to the surface of the object. To ensure a precise imprint and transfer of the image during stamping, the stamping device further comprises a base positioned across the upper region, beneath the transfer medium.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate preferred embodiments of the invention and, together with the description, serve to explain the principles of the invention. In the drawings.

DESCRIPTION OF THE PREFERRED EMBODIMENT(S)

Reference will now be made in detail to several preferred embodiments of the invention, examples of which are illustrated in the accompanying drawings. Wherever possible, the same reference numbers will be used throughout the drawings to refer to the same or like parts.

In accordance with the invention, there is provided a stamping device that transfers a stamped image to an irregularly surfaced object with increased precision, adaptability, and ease of use. The stamping device includes a frame having an upper region and a transfer medium mounted across the upper region of the frame. The stamping device of the present invention simplifies the stamping process by eliminating the need for complex mechanical devices and mechanically increased forces. Furthermore, the design of the stamping device promotes the freehand transfer of images to objects of varying dimensions.

Figure 1:
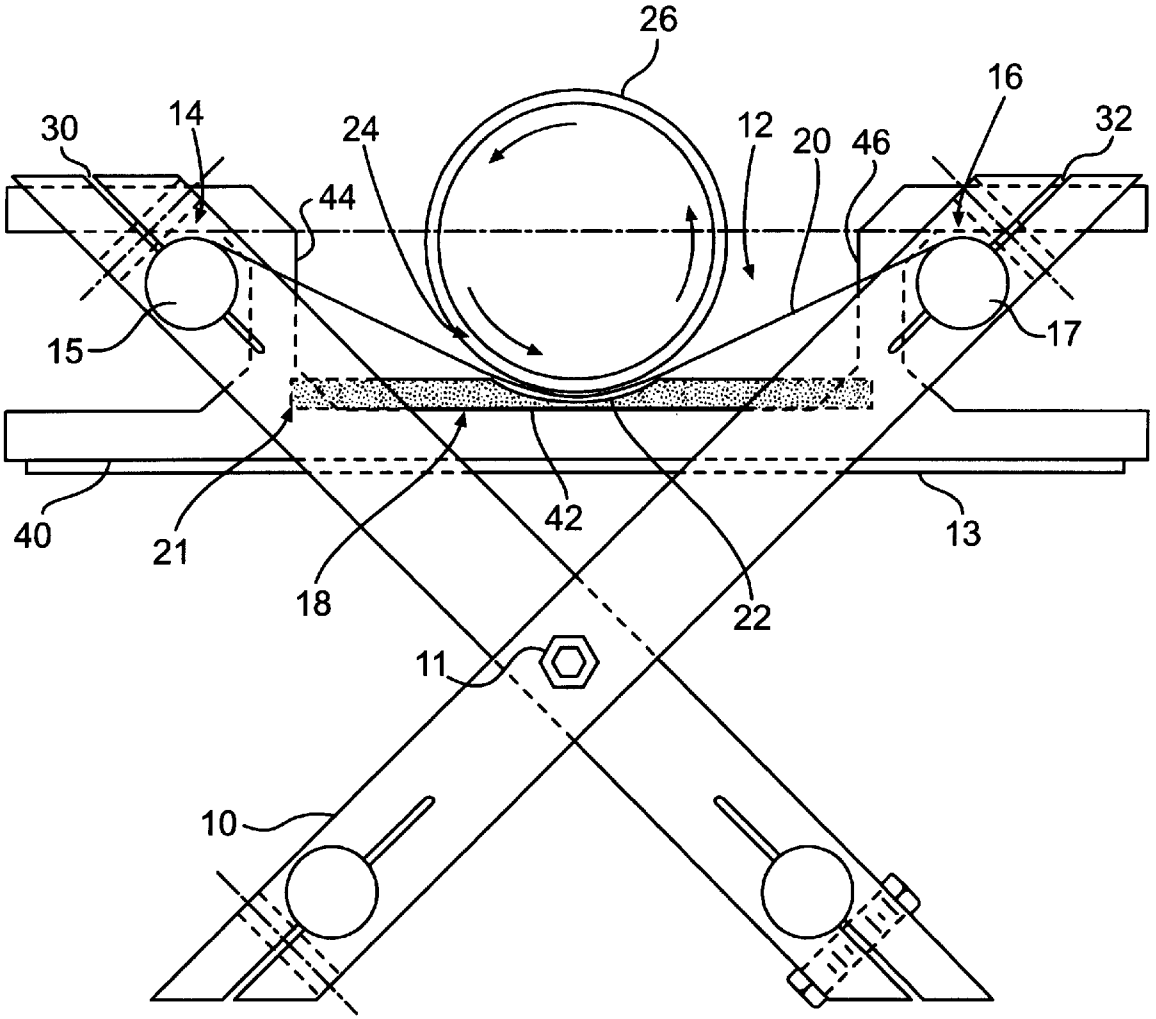
FIG. 1 is a side view illustration of a preferred embodiment of a stamping device according to the present invention.
Figure 2:
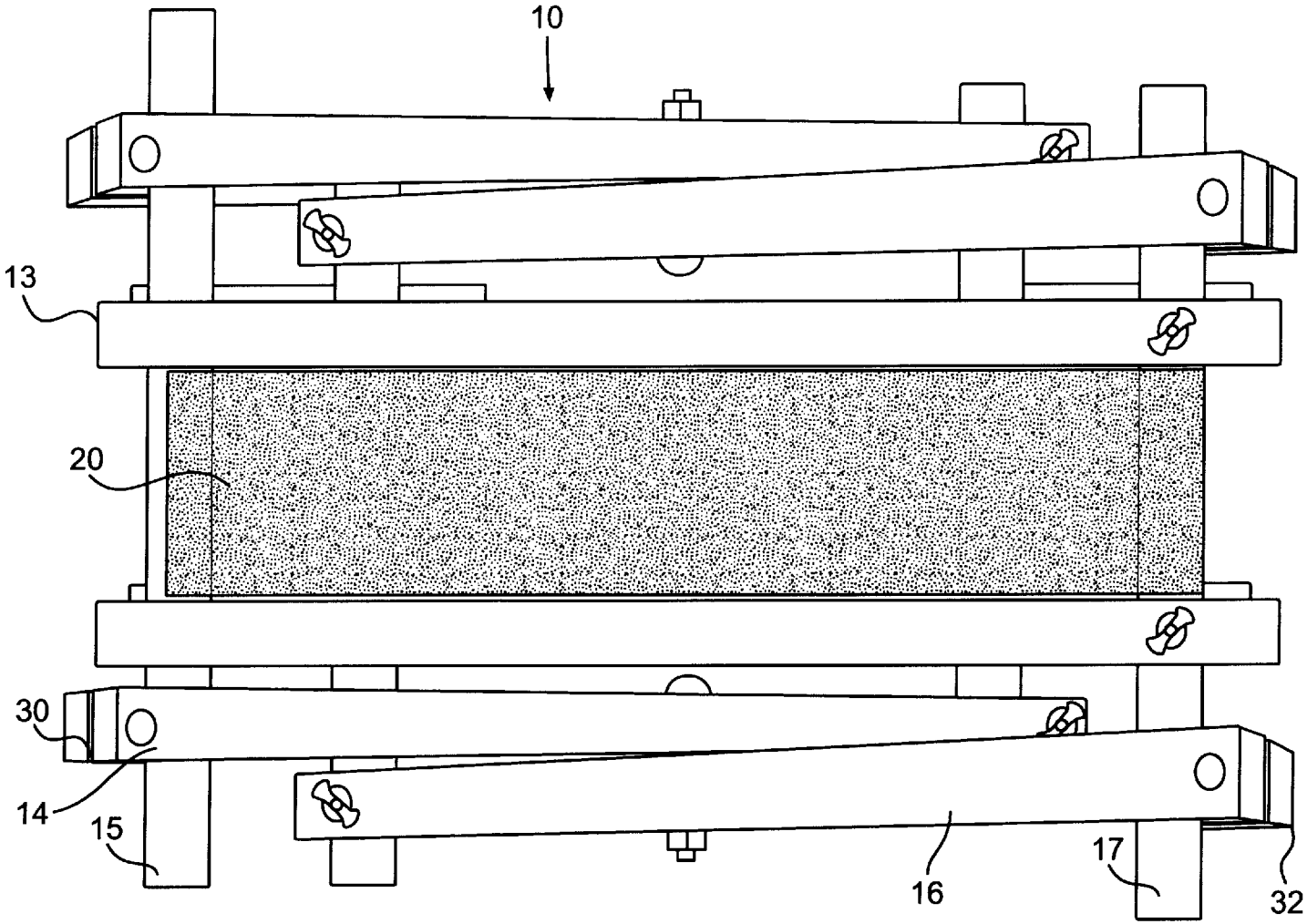
FIG. 2 is a top view illustration of a preferred embodiment of a stamping device according to the present invention.
Figure 3:
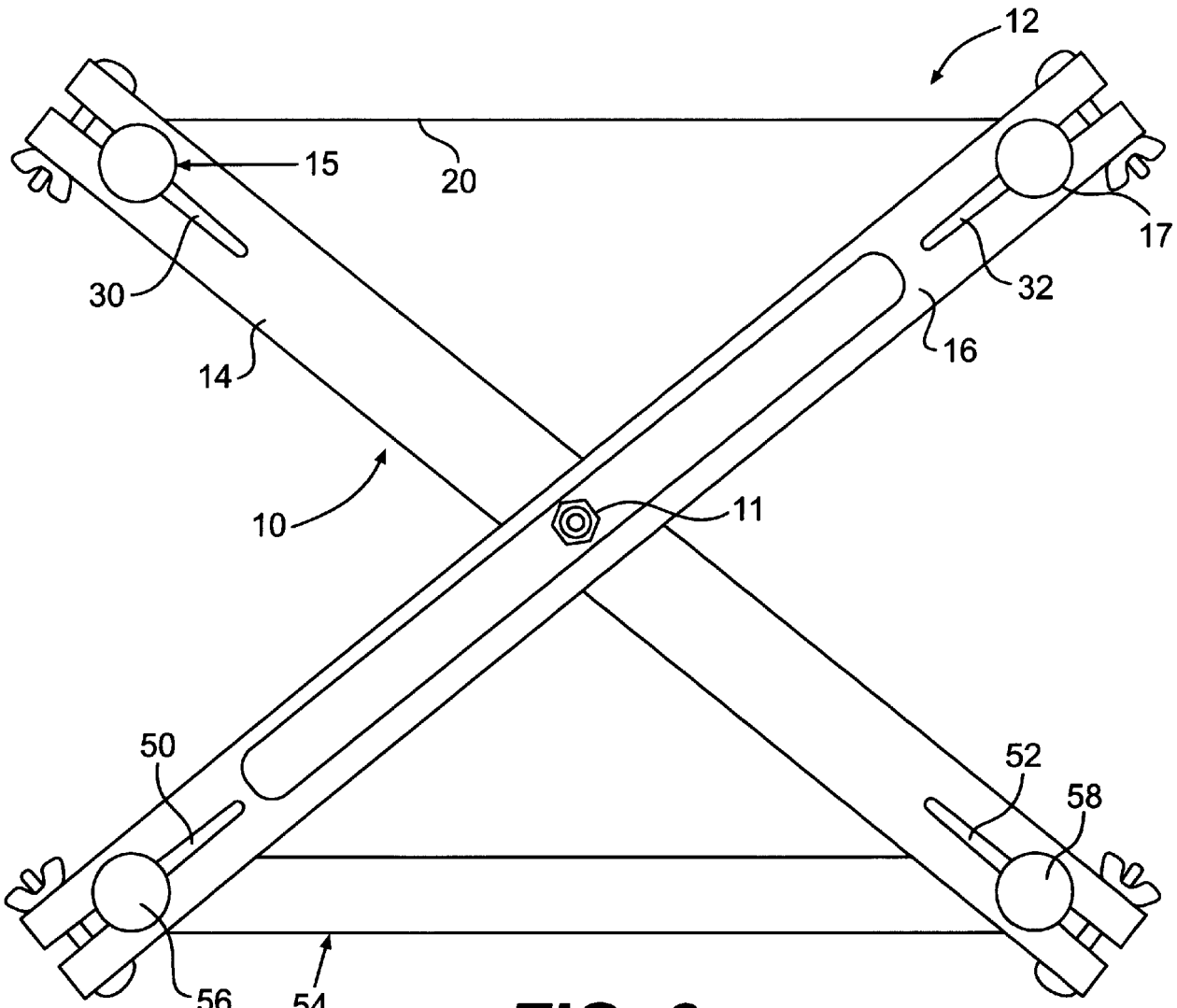
FIG. 3 is a side view illustration of a preferred embodiment of a stamping device according to the present invention.

FIGS. 1–3 illustrate a first preferred embodiment of a stamping device according to the present invention. As illustrated, the stamping device includes frame 10 having first support member 14, second intersecting support member 16, and upper region 12. As illustrated, upper region 12 is an opening above and between the intersection of members 14, 16. To facilitate the stamping of an image to an irregularly surfaced object, flexible transfer medium 20 is positioned across upper region 12, from first member 14 to second member 16. Transfer medium 20 is uniquely designed to receive an image from a stamp block and transfer the image to an irregularly surfaced object. To enhance the precision of the stamping process, a base 13 may be disposed at upper region 12. The addition of base 13 provides a surface that not only assists in the imprinting of the image to medium 20 but also supports the object to be printed during the image transfer process.

Preferably, frame 10 is designed to collapse between an open erect configuration and a closed compact configuration. In the embodiment illustrated in FIGS. 1–3, frame 10 includes pivot point 11, which allows frame 10 to easily collapse from the open configuration, where members 14, 16 are spaced apart from one another, to the closed configuration, where members 14, 16 are adjacent to one another. Frame 10 is opened to provide at least the spacing necessary for upper region 12 to receive the irregularly surfaced object to be printed.

Once the frame 10 is erected, it can be locked in position by simply restraining the movement of members 14, 16 at pivot point 11. As illustrated in FIGS. 1–3, this restraint is preferably obtained by a fastening screw and bolt system positioned at pivot point 11, where tightening the fastening system provides the necessary tension to lock frame 10 in position. Although only a screw and bolt system is depicted and described, other conventional fastening mechanisms may be used. In addition, frame 10 is not limited to the one pivot point depicted in FIG. 1, as frame 10 may include various pivot points, where these additional pivot points permit further compaction of frame 10 in its closed configuration. The frame also could be a rigid frame that does not fold into a more compact form and still provide many of the functions of the present invention.

Figure 4:
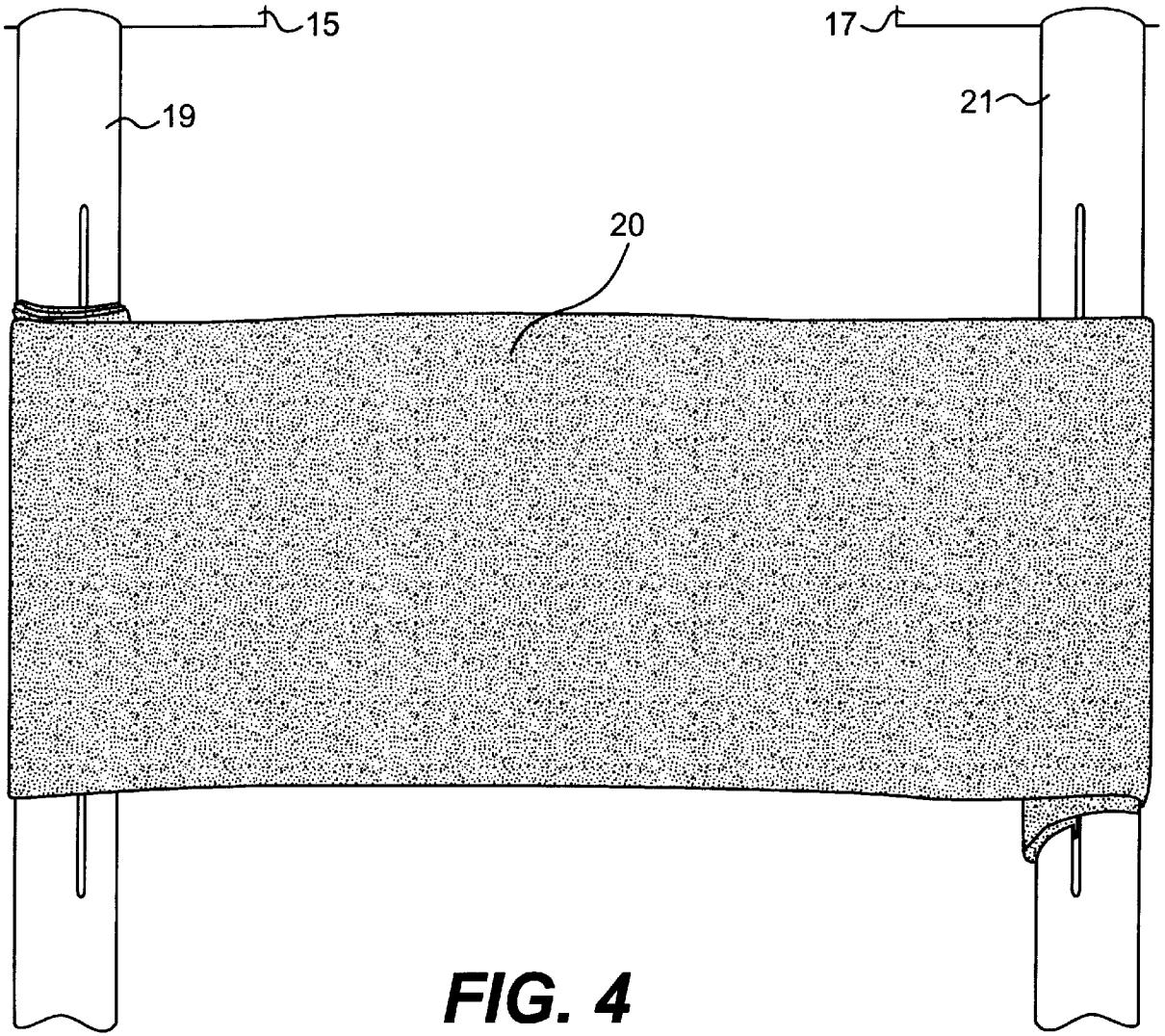
FIG. 4 is a top view illustration of a transfer medium incorporated in a stamping device according to the present invention.

To facilitate the stamping process, transfer medium 20 is disposed across members 14, 16 of frame 10. Although each end of transfer medium 20 may attach directly to members 14, 16, it is preferred that the ends of transfer medium 20 first attach to narrow regions 19, 21 of cylindrical pegs 15, 17, where pegs 15, 17 affix to members 14, 16, as depicted in FIGS. 1 and 4.

To maintain the adaptability of the stamping device of the present invention, members 14, 16 are preferably configured to removably receive pegs 15, 17 through respective slots 30, 32. The allocation of slots 30, 32 allows for the rapid removal of pegs 15, 17, so that medium 20 may be easily substituted or transported separately from frame 10. To permit rapid retention of narrow regions 19, 21 of pegs 15, 17, each of slots 30, 32 include a fastening screw and bolt system preferably positioned at the outer edge of frame 10, as illustrated in FIG. 3. Once narrow regions 19, 21 are inserted, each respective fastening system is tightened to provide the necessary tension between slots 30, 32 and pegs 15, 17 to restrain medium 20 in position. To remove or reposition medium 20, the user need only loosen the fastening system to allow movement of narrow regions 19, 21 within slots 30, 32.

In the preferred configuration, the extended length of transfer medium 20 exceeds the generally horizontal distance across upper region 12, so that transfer medium 20 can scroll around at least one of narrow regions 19, 21. As constructed, transfer medium 20 provides the user with a plurality of individual stamping surfaces, where these individual surfaces may be obtained by scrolling medium 20 to a previously unused section scrolled around at least one of narrow regions 19, 21. This adaptability allows the stamping device to transfer differing images without replacing medium 20.

The availability of individual stamping surfaces may be further increased by providing slots 50, 52 on members 14, 16 at lower region 51 of frame 10, as illustrated in FIG. 3. The allocation of slots 50, 52 permits frame 10 to receive an additional transfer medium 54 scrolled around pegs 56, 58. The provision of second transfer medium 54 greatly increases the individual stamping surfaces available to the user without adding unnecessary complexities to the stamping device.

Before initiating the stamping process, the stamping device must first be assembled by positioning and adjusting narrow regions 19, 21 within slots 30, 32, so that medium 20 not only lays substantially taunt across upper region 12 of frame 10 but also provides the necessary spacing for upper region 12 to receive the irregularly surfaced object. In the assembled position illustrated in FIG. 1, transfer medium 20 provides a substantially taut surface for receiving and transferring the stamp image. To retain its extension across upper region 12, medium 20 is preferably made of an elastomeric material, such as latex. Although various types of latex may be used, it is preferred that transfer medium 20 be made of a natural latex material having a sixteen mill band thickness. The elastomeric properties of medium 20 enable it to return to its substantially taut extension across upper region 12 after continued deformation. Such resilience allows the stamping device of the present invention to repeatedly transfer an image to numerous objects.

To assist in image transfer, medium 20 preferably includes a surface having a positioning grid 60 printed thereon, as illustrated in FIG. 4. The provision of grid 60 allows the user to accurately align stamp block 27 as well as surface 24 with transfer medium 20. Although only a rectangular pattern is depicted, various geometric grid patterns may be used, each pattern enhancing the accuracy of image transfer.

Figure 6:
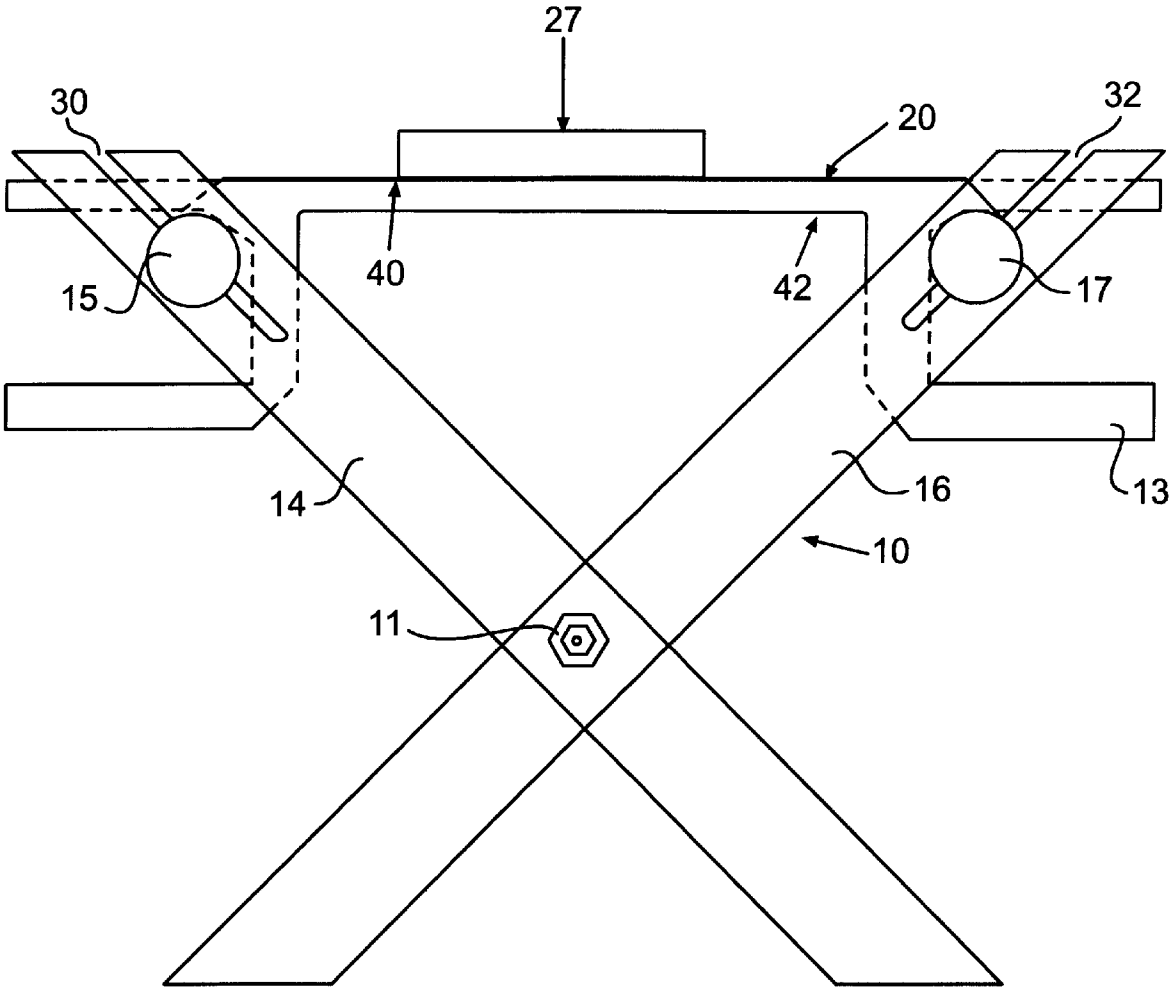
FIG. 6 is a side view illustration of a third embodiment of a stamping device according to the present invention.

Once the stamping device is assembled, the actual stamping process begins with the imprinting of the image from a stamp block to medium 20, as depicted, for example, in FIG. 6. To imprint the image, the user lightly presses the design surface of stamp block 27 atop the taut upper surface of medium 20. Although a surface, such as base 13, illustrated in FIG. 6, is not necessary, it is preferred that a substantially rigid planar surface be positioned beneath the lower surface of medium 20 to assist in the receipt of a precise imprint. As positioned, the user need only compress medium 20 between stamp block 27 and the substantially rigid planar surface to imprint the image.

Figure 8:
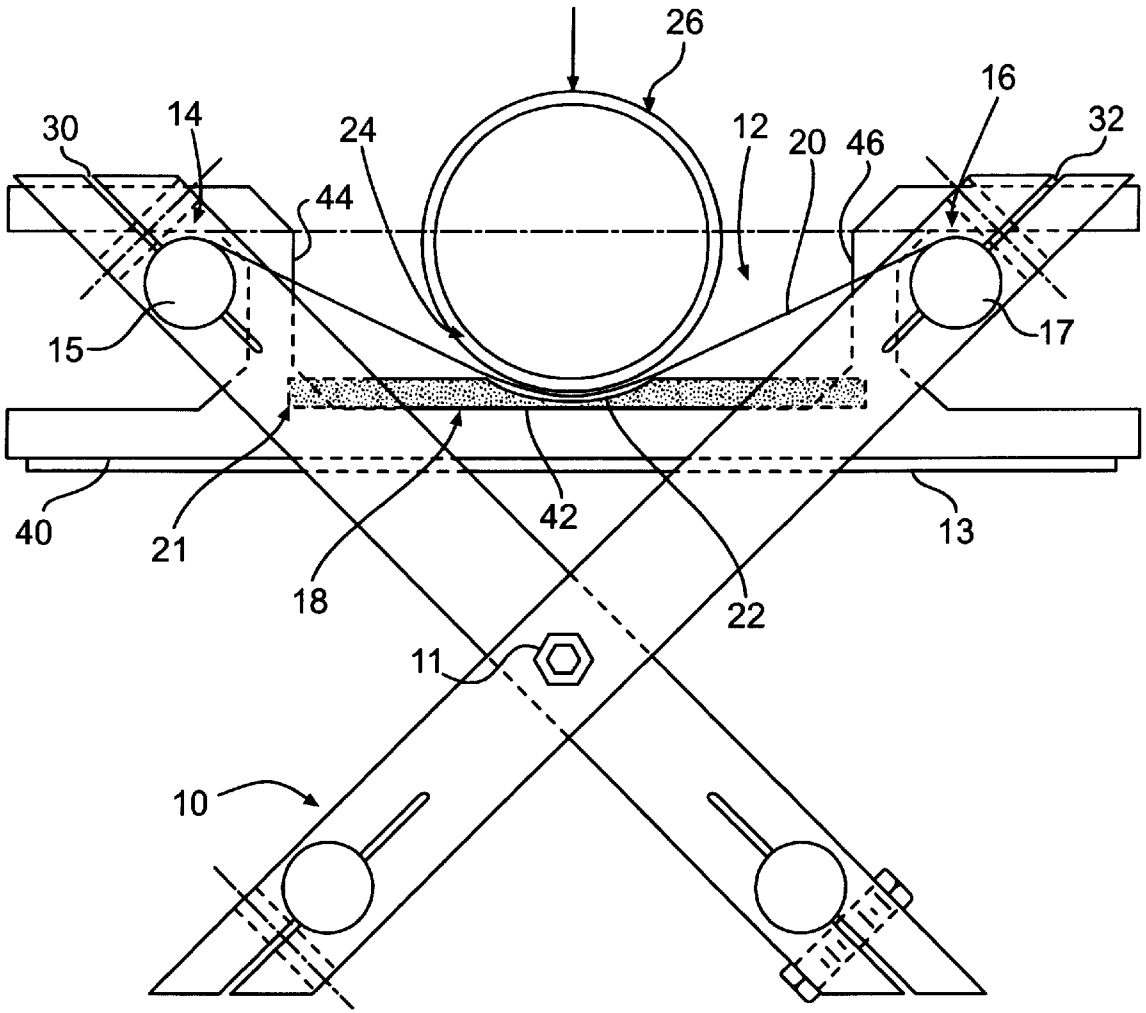
FIG. 8 is a side view illustration of a fourth embodiment of a stamping device according to the present invention.

The technique used to transfer the image imprinted on medium 20 to the irregularly surfaced object depends upon the dimensions of the image as well as the object. For example, for images limited to a small portion of surface 24 of object 26, the user simply places surface 24 over the imprinted image on medium 20 and lightly presses surface 24 downward onto the imprinted image, as illustrated in FIG. 8. Alternatively, for larger images or images occupying large surface areas, the user places surface 24 on medium 20 at the point where the image begins and gently rolls object 26 until the image is completely transferred to surface 24, as illustrated in FIG. 1. Regardless of particular image dimensions, the present invention offers a practical stamping device that provides a practical technique for stamping an image to an irregularly surfaced object that requires no extraordinary forces or complex machinery.

To ensure a precise imprint and transfer during stamping, one preferred embodiment of the stamping device includes base 13 positioned along upper region 12. So that frame 10 can continue to enjoy its collapsible design, base 13 is preferably constructed for easy removal from frame 10. For example, as illustrated in FIGS. 1 and 6, in the open erect configuration of frame 10, base 13 resides on pegs 15, 17, from member 14 to member 16 of frame 10. As configured, base 13 may be easily removed and reinserted in frame 10. Once base 13 is removed, frame 10 may collapse, and base 13 and frame 10 may be separately stored or transported. The simplicity of the design and interaction between base 13 and frame 10 further promotes the adaptability of the stamping device, since base 13 may be easily replaced by a base having dimensions that better conform to the shape of the object to be printed.

Figure 7:
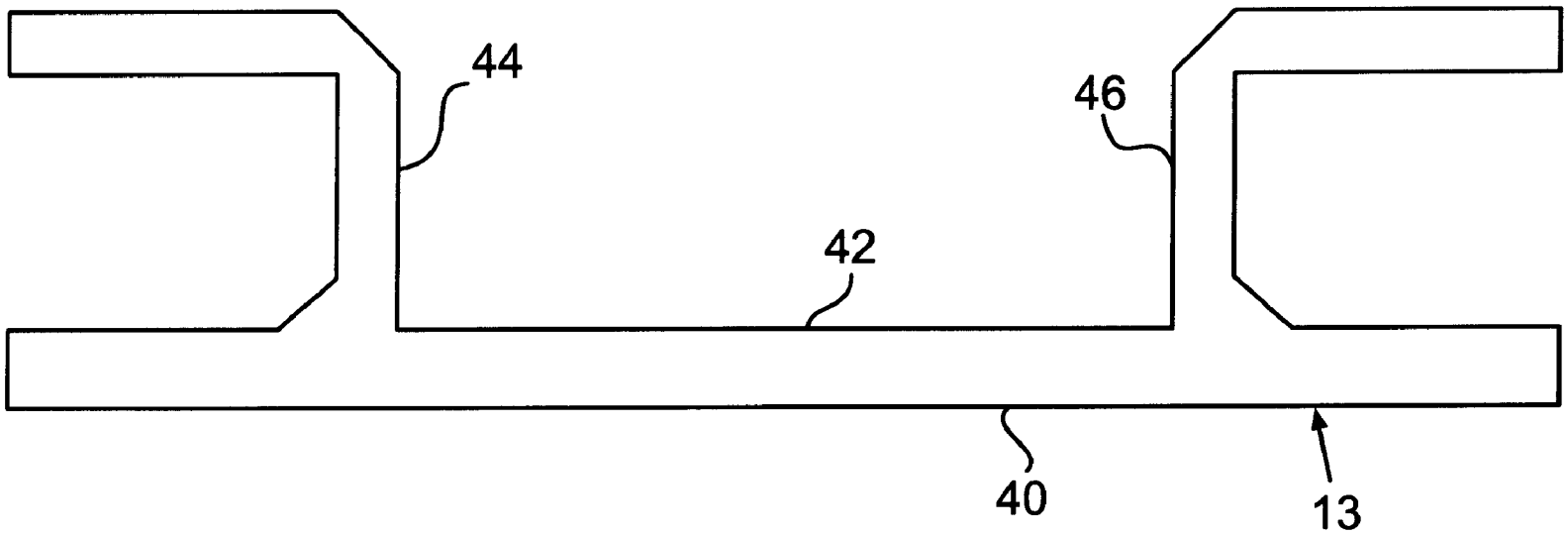
FIG. 7 is a side view illustration of a base incorporated in a stamping device of FIG. 6, according to the present invention.

As illustrated in FIG. 7, base 13 includes a first surface 40 and a second surface 42 positioned between vertical walls 44, 46. During the imprinting process, base 13 is disposed in frame 10, as depicted in FIG. 6, with first surface 40 positioned adjacent to medium 20, such that first surface 40 of base 13 provides a hard surface beneath the lower surface of medium 20. As previously described, the placement of first surface 40 enhances the imprinting process, because medium 20 is pressed firmly between stamp block 27 and first surface 40 of base 13.

When transferring the image imprinted on medium 20 to the irregularly surfaced object, base 13 is disposed in frame 10 with second surface 42 positioned closest to medium 20, as illustrated in FIG. 1. Because vertical walls 44, 46 terminate at second surface 42, second surface 42 resides beneath medium 20 a distance equal to the height of vertical walls 44,46. This distance between the lower surface of medium 20 and second surface 42 provides sufficient space for medium 20 to conform to surface 24 of object 26 during the image transfer process.

To further improve precision during image transfer, a pad 21 may be positioned atop second surface 42 of base 13. Preferably, pad 21 is made of a semi-rigid material, such as foam. The semi-rigid pad is preferably shaped to conform to the surface of the object to be printed. For example, as illustrated in FIG. 1, pad 21 includes a concave depression 22, mirroring the convex surface 24 of object 26. The elasticity of medium 20 allows that medium to stretch from the pressure applied by the irregularly surfaced object, such that medium 20 is deflected toward pad 21. Once in contact with pad 21, the complementary nature of depression 22 and surface 24 improves the contact between medium 20 and surface 24. By improving this contact area, the image is transferred with heightened accuracy and precision.

In the event a pad having a complementary depression is unavailable, similar results may still be obtained by using a pad made of a malleable, elastomeric-like material. Such a pad would similarly allow medium 20 to enjoy an increased contact area with surface 24 of object 26, by conforming to the shape of object 26. Because of its elasticity, the pad would return to its original undeformed shape for repeated use by objects of varying dimensions.

In summary, regardless of the particular configuration, the stamping device of the present invention enables users to transfer an image to an irregularly surfaced object with not only increased clarity but also reduced distortion, and without the addition of burdensome forces, procedures, or machinery. The simple and collapsible design of the stamping device not only overcomes the complexities introduced by conventional stamping devices but also promotes compact storage of the device. The compactness of the closed configuration of the frame also overcomes difficulties associated with the transport and storage of conventional stamping devices. To further promote its portable characteristics, the stamping device is preferably constructed of a lightweight material. For example, frame 10, pegs 15, 17, and base 13 may be constructed of a plastic, metallic, or wood-like material.

Figure 5:
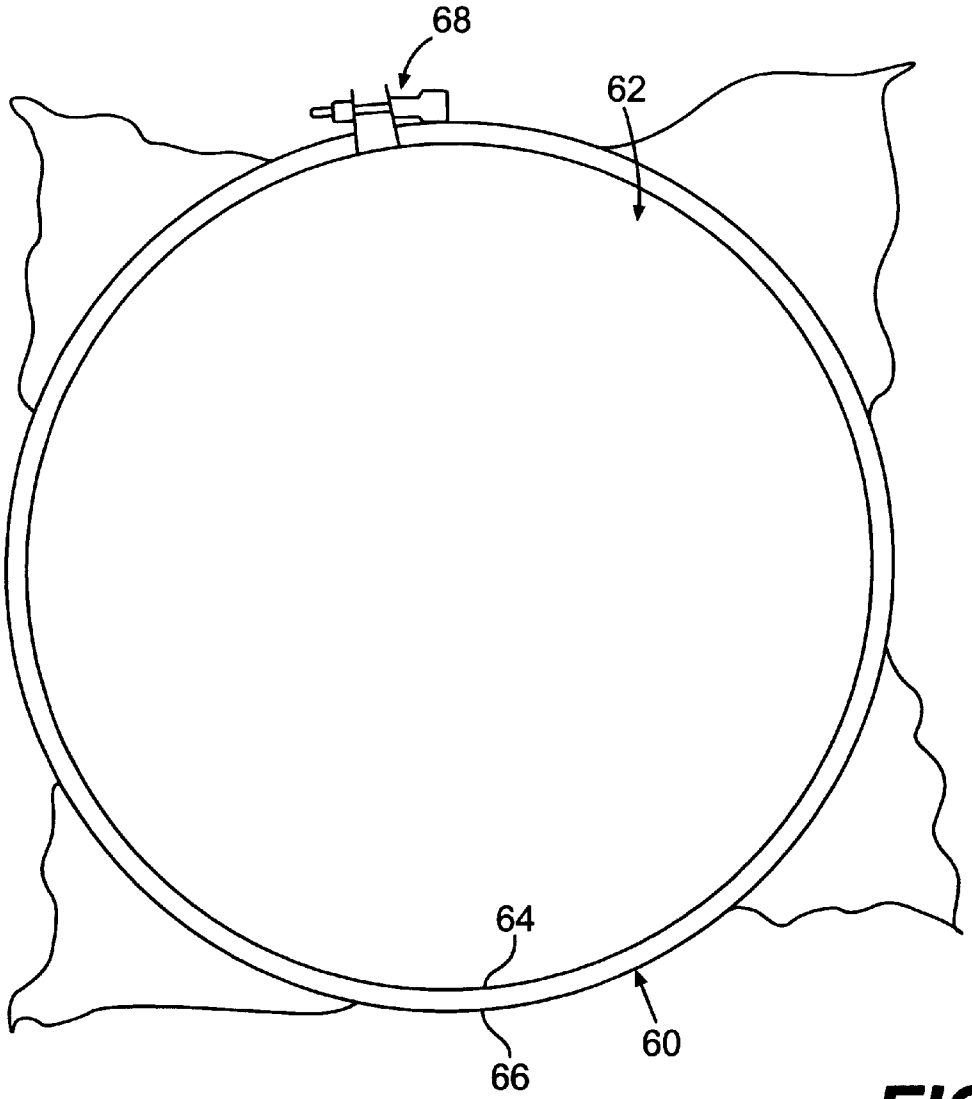
FIG. 5 is a top view illustration of a second embodiment of a stamping device according to the present invention.

It will be apparent to those skilled in the art that various modifications and variations can be made in the stamping device of the present invention and in construction of this device without departing from the scope or spirit of the invention. Indeed, any frame configuration may be incorporated in the stamping device, as long as sufficient space is provided for medium 20 to first receive the stamp image and then transfer the image to the irregularly surfaced object by conforming to the shape of the irregular surface. For example, the stamping device illustrated in FIG. 5 may be used to accurately transfer a stamped image to an irregularly surfaced object. As depicted in FIG. 5, frame 60 includes inner 64 and outer edge 66 through which transfer medium 62 is received and retained. Once medium 62 is positioned between edges 64, 66 of frame 60, outer edge 66 is compressed onto inner edge 64 by fastening screw and bolt system 68. Tightening of fastening system 68 provides the necessary tension to retain medium 62 in a substantially taunt position across frame 60. As assembled, the stamping process may proceed as previously depicted and described. With regards to the particular dimensions of frame 60, the depth and surface area of frame 60 may vary depending on the surface of the object to be printed. Similarly, the configuration of frame 60 is not limited to the circular shape depicted in FIG. 5, as frame 60 may assume various geometric configurations, including oval and rectangular prisms.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A device for transferring an image from a stamp to a surface of an object to be printed, the device comprising:

a frame having an upper region capable of receiving the surface of the object to be printed; and a transfer medium mounted across the upper region of the frame for receiving the image from the stamp and transferring the image to the surface of the object, said transfer medium being made of a flexible and resilient latex material, and including a surface having a positioning grid located thereon.

2. A device for transferring an image from a stamp to a surface of an object to be printed, the device comprising:

a frame having a first and a second side and an opening formed between the first and second sides, the opening being adapted to receive the surface of the object to be printed;

a transfer medium for receiving the image from the stamp and transferring the image to the surface of the object to be printed, said transfer medium being mounted across the first and the second side of the frame and extending over the opening;

a base disposed across the opening and beneath the transfer medium; and a receiving pad disposed in the base, said receiving pad having a surface shaped complementary to the surface of the object to be printed.

3. The device of claim 2, wherein said base is configured for rapid insertion and removal in the opening of said frame.

4. The device of claim 3, wherein said base includes a hard surface and an opposing soft surface.

5. The device of claim 4, wherein said base is positioned in the opening of said frame with the hard surface facing said transfer medium during image imprinting from the stamp and with the soft surface facing said transfer medium during image transferring to the surface of the object to be printed.

6. The device of claim 2, further comprising a bar positioned at the upper region of each of the sides of said frame, each bar retaining opposing ends of said transfer medium.

7. The device of claim 6, wherein the extended length of said transfer medium exceeds the generally horizontal length across the opening of said frame.

8. The device of claim 7, wherein at least one end of said transfer medium is rolled around its respective bar so that the length of said transfer medium extending between the bars substantially equals the generally horizontal length across the opening of said frame.

9. The device of claim 8, wherein each of said bars is capable of rotating to scroll a new section of said transfer medium across the opening of said frame.

* * * * *